US012343587B2

(12) United States Patent
Vaudreuil

(10) Patent No.: US 12,343,587 B2
(45) Date of Patent: Jul. 1, 2025

(54) CALF EXERCISE FOOT POSITIONER

(71) Applicant: Michael P. Vaudreuil, Vernon, CT (US)

(72) Inventor: Michael P. Vaudreuil, Vernon, CT (US)

( * ) Notice: Subject to any disclaimer, the term of this patent is extended or adjusted under 35 U.S.C. 154(b) by 352 days.

(21) Appl. No.: 17/729,739

(22) Filed: Apr. 26, 2022

(65) Prior Publication Data

US 2022/0339490 A1 Oct. 27, 2022

Related U.S. Application Data

(60) Provisional application No. 63/180,347, filed on Apr. 27, 2021.

(51) Int. Cl.
*A63B 21/00* (2006.01)
*A63B 23/04* (2006.01)

(52) U.S. Cl.
CPC ..... *A63B 21/4034* (2015.10); *A63B 23/04* (2013.01)

(58) Field of Classification Search
CPC ..... A63B 21/4034; A63B 21/0552; A63B 21/0628; A63B 21/4047; A63B 21/068; A63B 23/04; A63B 23/08–085; A63B 17/00; A63B 2023/006; A63B 69/3667–3673; A63B 22/16; A63B 26/003

See application file for complete search history.

(56) References Cited

U.S. PATENT DOCUMENTS 4,376,532 A * 3/1983 Hunstad ..... A63B 69/18 482/146
4,515,363 A * 5/1985 Schleffendorf .. A63B 23/03533 482/136
5,368,536 A * 11/1994 Stodgell ..... A63B 22/18 482/79
6,740,011 B1 * 5/2004 Tsai ..... A63B 22/16 482/80
8,574,134 B2 * 11/2013 Greenburg ..... A63B 21/40 482/79
11,154,751 B2 * 10/2021 Bosch ..... A63B 23/0216

* cited by examiner

*Primary Examiner* — Loan B Jimenez
*Assistant Examiner* — Kathleen M Fisk
(74) *Attorney, Agent, or Firm* — Armis IP Law, LLC

(57) ABSTRACT

A calf exerciser includes a free standing platform with independent foot braces that pivot and rotate for providing an optimally positioned foot and ankle position for a calf exercise. A pair of rotating platforms mount to a base, and each rotating platform has a pivot brace that angles left and right. Positioning and locking the foot braces at various positions of rotation and right/left angles provide a selectable, varied position as the calf exercises generally involve an ankle driven force against the foot braces, often bearing on the ball or arch of the foot. A beveled or curved edge with a grip surface further enhances contact with the user's foot.

12 Claims, 7 Drawing Sheets

CALF EXERCISE FOOT POSITIONER

RELATED APPLICATIONS

This patent application claims the benefit under 35 U.S.C. § 119(e) of U.S. Provisional Patent App. No. 63/180,347, filed Apr. 27, 2021, entitled "CALF EXERCISE FOOT POSITIONER," incorporated herein by reference in entirety.

BACKGROUND

Exercise machines, devices and apparatus are popular appliances for facilitating the use of weights in resistance-based training. Such devices come in many forms, but are often defined by a free standing frame with various attachments, extensions, and exercise-specific accessories. Calf exercisers are a popular type of exercise machine, and define an elevated surface or bar that allows a user's heel to drop lower than the ball of the foot for providing a range of motion of the ankle/heel above and below the ball of the foot.

SUMMARY

A calf exerciser includes a free standing platform with independent foot braces that pivot and rotate for providing an optimally positioned foot and ankle position for a calf exercise. A pair of rotating platforms mount to a base, and each rotating platform has a pivot brace that angles left and right. Positioning and locking the foot brace at various positions of rotation and right/left angles provide a selectable, varied position as the calf exercises generally involve an ankle driven force against the foot brace, often bearing on the ball or arch of the foot. A beveled or curved edge with a grip surface further enhances contact with the user's foot.

Configurations herein are based, in part, on the observation that calf exercisers are a popular exercise regimen in both home and commercial gym exercise contexts. Calf exercisers typically employ a weight stack or other resistance means in configuration to be displaced by a user positioned for a calf lifting/extension movement. Typically this rests the ball/toe region of the foot on an elevated surface to allow the heel to move above and below the position of the surface based on calf driven movements. Unfortunately, conventional approaches to calf exercisers suffer from the shortcoming that the bearing surface for the toe is typically a fixed, straight base that supports a single pattern for a foot position. Accordingly, configurations herein substantially overcome the shortcomings of conventional calf exercisers by providing a repositionable base with independently rotatable and pivotable foot braces, allowing a user to reposition for receiving a counterforce from the user's foot/ankle in providing resistance to calf movement/exercise.

Conventional exercise apparatus employ a frame and mechanical resistance elements such as weights, elastic/rubber/polymer strands, or other linkage for providing resistance against an exerted muscular force. While arms and legs are common members for exertion against the mechanical resistance, calf exercisers allow the user to elevate the heel on the ball of the foot for movement of the resistive force. Posturing for calf exercise is similar to arm lifting exercises, except that the heels are extended using the calf muscles instead of the arms for elevation or movement against the resistive force. Arm lifting exercises may easily be adapted to calf exercise using the disclosed apparatus (device) for elevating the ball/toe of the foot region and extending the calf instead of the arms.

The disclosed apparatus, therefore, may be employed with a preexisting weight frame or resistance apparatus, or as a stand-alone implement. Conventional calf exercisers are implemented as an afterthought to an exercise rack or frame, and include only a fixed horizontal bar or surface for elevating the front of the foot. Such conventional surfaces are fixed, and provide no ability to alter the user stance for allowing the feet to achieve an alternate rotation or pivot angle while bearing weight.

In further detail, the disclosed approach depicts a foot positioning apparatus that allows for varying foot orientation during an exercise regimen, including opposed rotating platforms disposed in an adjacency on a plane for rotation parallel to the plane, and pivoting foot braces on each of the rotating platforms, such that each of the foot braces is disposed to pivot perpendicular to the plane for rotation. A locking mechanism secures the position of the rotation and an angle of the pivot independently for each rotating platform, or alternately rotates the platforms together through a rotational linkage.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

The description below presents an example of the foot positioning apparatus (brace) used for calf exercises with or without an accompany weight rack or exercise frame. The foot positioning apparatus may be integrated as part of a larger exercise machine, and may also be deployed as a standalone aid placed in adjacency with a resistance (weight) training implementation. The approach described below may employ various materials for construction, and alternate fabrication of materials may follow from configurations described below.

Figure 1:
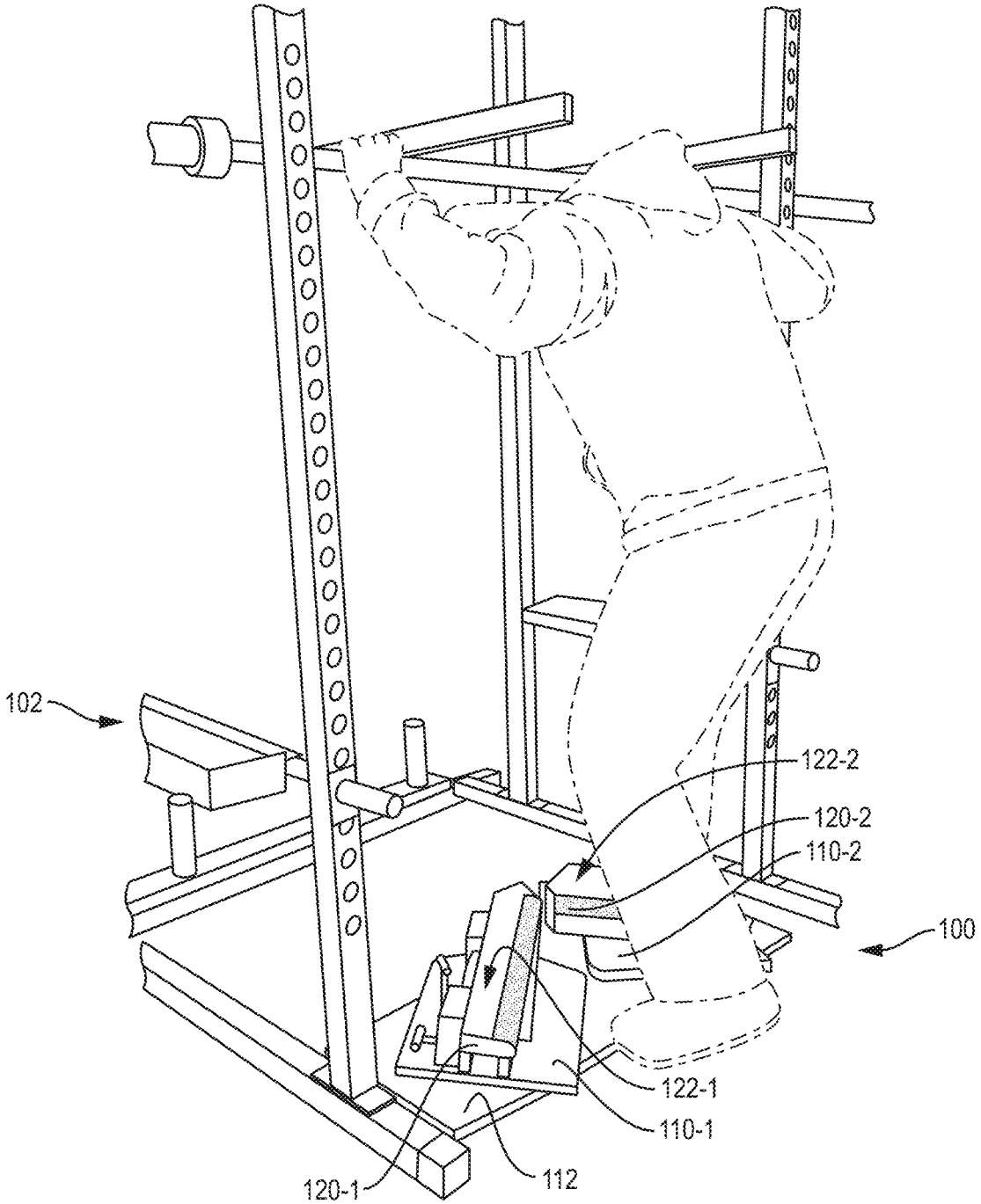
FIG. 1 is a front perspective view on an exercise environment and apparatus suitable for use with configurations herein.

FIG. 1 is a front perspective view on an exercise environment and apparatus suitable for use with configurations herein. Calf exercises are a popular part of many exercise and fitness routines. Calf exercise machines may be dedicated frames directed to calf exercise, while other configurations, particularly home machines, may attempt to utilize a common weight stack or arrangement with multiple exercise devices or movements. In configurations herein, the foot positioning apparatus 100 for varying foot orientation during an exercise repetition includes opposed rotating platforms 110-1 . . . 110-2 (110 generally) disposed in an adjacency on a base 112 for rotation parallel to the plane underlying the frame 102 or other floor surface. Pivoting foot braces 120-1 . . . 120-2 (120 generally) rest on each of the rotating platforms 110, such that each of the foot braces 120 is disposed to pivot in a pivot plane perpendicular to the plane for rotation, and a locking mechanism secures a position of the rotation and an angle of the pivot independently for each rotating platform. The apparatus 100 therefore provides a foot brace adapted to receive each foot at the fixed rotation and pivot, providing movement of the foot brace in 3 dimensions defined by perpendicular planes. The foot positioning apparatus 100 may be a primary fixture of a calf exerciser, an accessory or an attachment to a calf exercise machine, or it may be a freely positionable base that may be simply placed beneath a resistance device or frame 102 and frictionally engaged from the underlying floor or additionally by the substantial downward force resulting from normal use. As the foot positioning apparatus 100 will bear the weight of the user, positioning is largely static and slippage or unintended movement is unlikely.

Figure 2A:
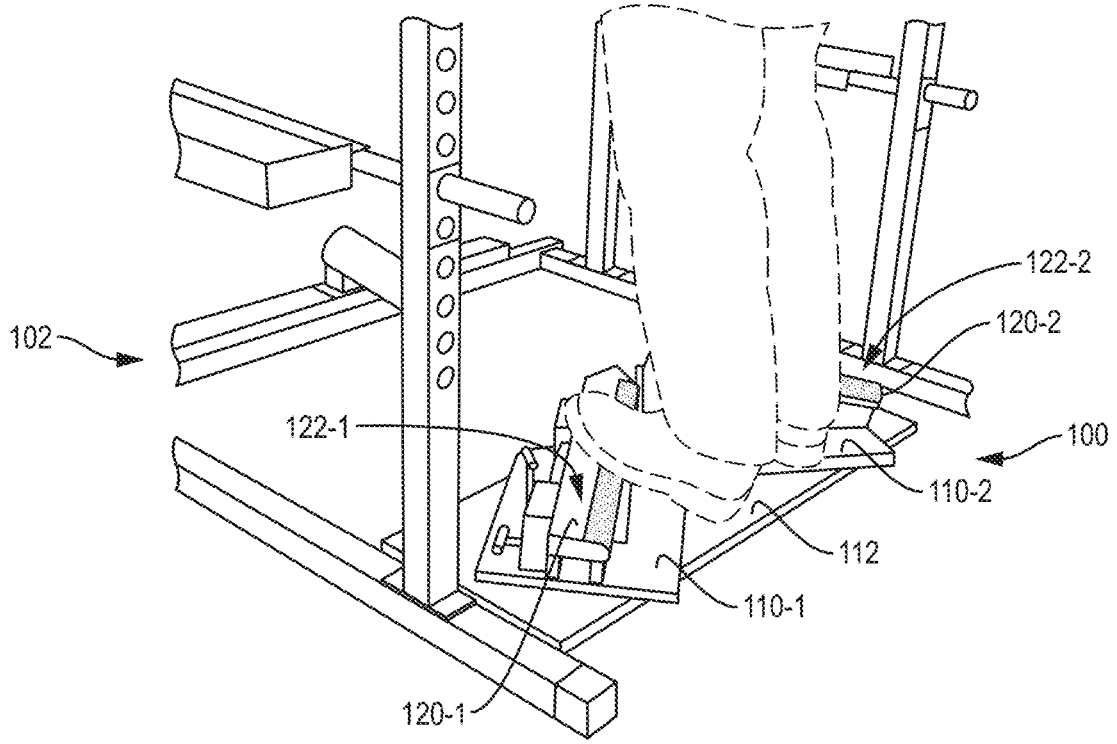
FIGS. 2A-2B show deployment and usage of the foot positioning apparatus of FIG. 1.
Figure 2B:
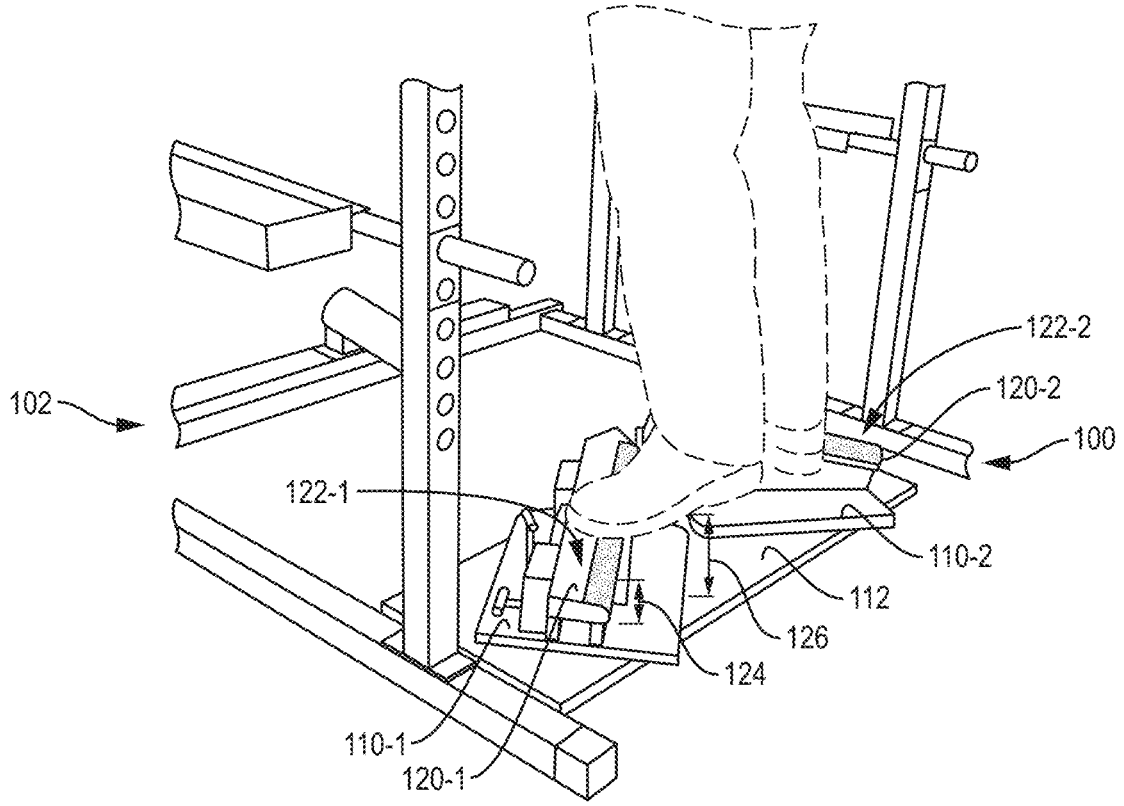

FIGS. 2A-2B show deployment and usage of the foot positioning apparatus of FIG. 1. Referring to FIGS. 1-2B, FIG. 2A shows a rest or commencement position where the user rests the toe or ball of the foot on the foot brace 120. A top surface of the foot brace 120 operates as a footrest 122-1 . . . 122-2 (122 generally) defined by an elevated surface having a predetermined elevation 124 above the rotating platforms. FIG. 2B shows an extension position where the predetermined elevation is based on a heel travel 126 imposing calf resistance, as the user elevates the heel against whatever resistance (or simply the user's own body weight) is grasped or held. The amount of heel travel 126 is based on the elevation 124 and the distance defined by an angle of elevation and the length of the user's foot. Successive iterations provide the calf resistance training sought.

Figure 3:
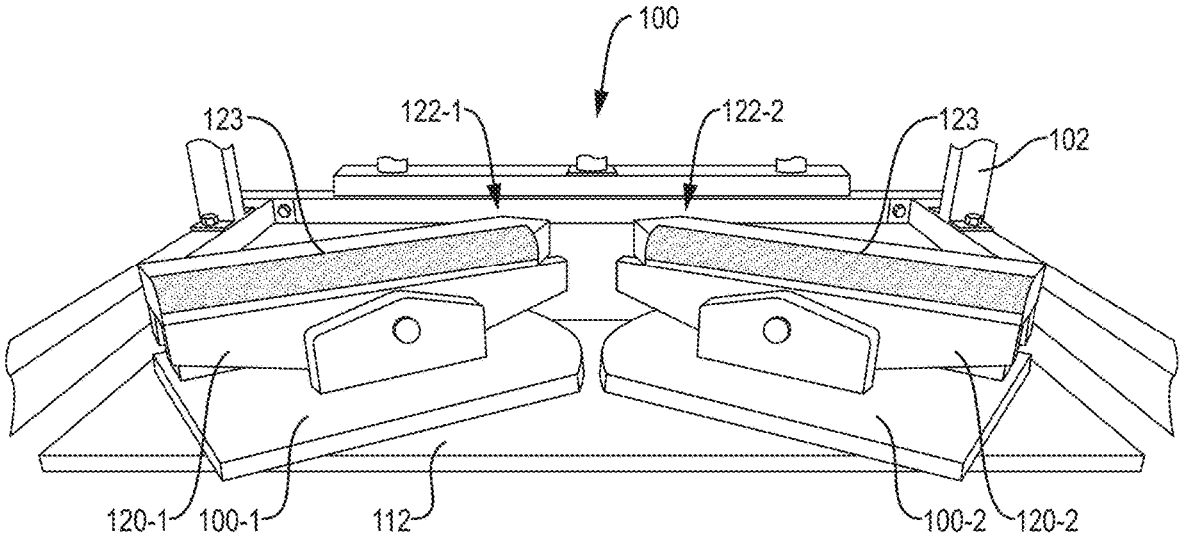
FIG. 3 shows a perspective view of the foot positioning apparatus of FIGS. 1 and 2.

FIG. 3 shows a perspective view of the foot positioning apparatus 100 of FIGS. 1 and 2. Referring to FIGS. 1-3, the foot brace 120 and footrest 122 may be of any suitable shape for receiving a shoe or footwear of the user, and may have a chamfered or rounded edge and/or frictional or rubberized material 123 for facilitating a frictional grip with the footwear. Generally the footwear bears on the foot brace via gravitational downward force of the user, and need not employ straps or other restraint.

Figure 4:
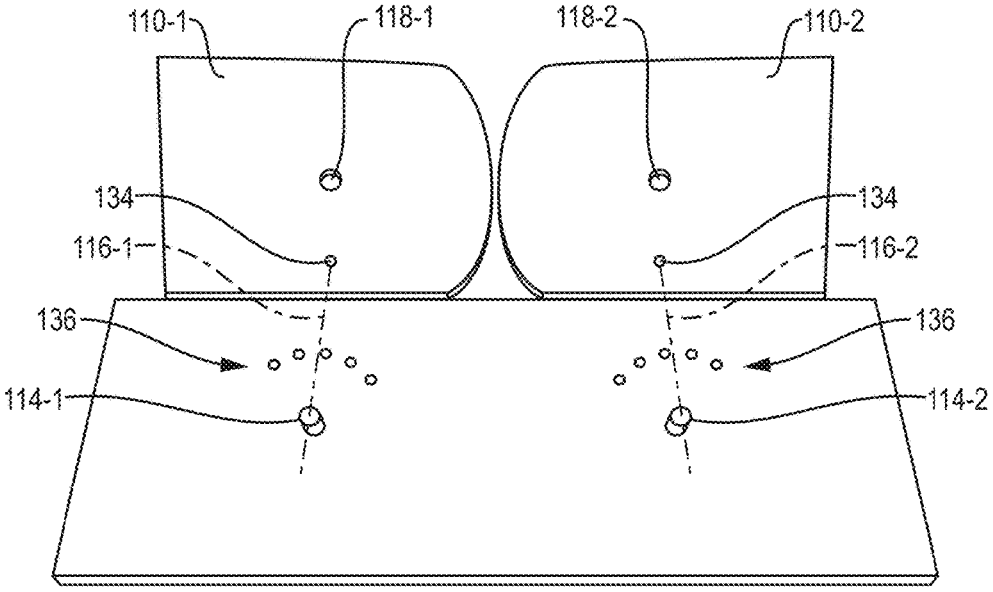
FIG. 4 shows a disassembled view of the rotating platforms in FIGS. 1-3.

FIG. 4 shows a disassembled view of the rotating platforms in FIGS. 1-3. Referring to FIGS. 1-4, the rotating platforms 110 each reside on the base 112, such that the base has a pair of protrusions 114-1 . . . 114-2 (114 generally) or shafts defining a respective axis of rotation 116-1 . . . 116-2 (116 generally) for each of the rotating platforms 110. The protrusions 114 extend through a receptacle 118-1 . . . 118-2 on a respective underside of each of the rotating platforms for rotation thereabout.

Figure 5:
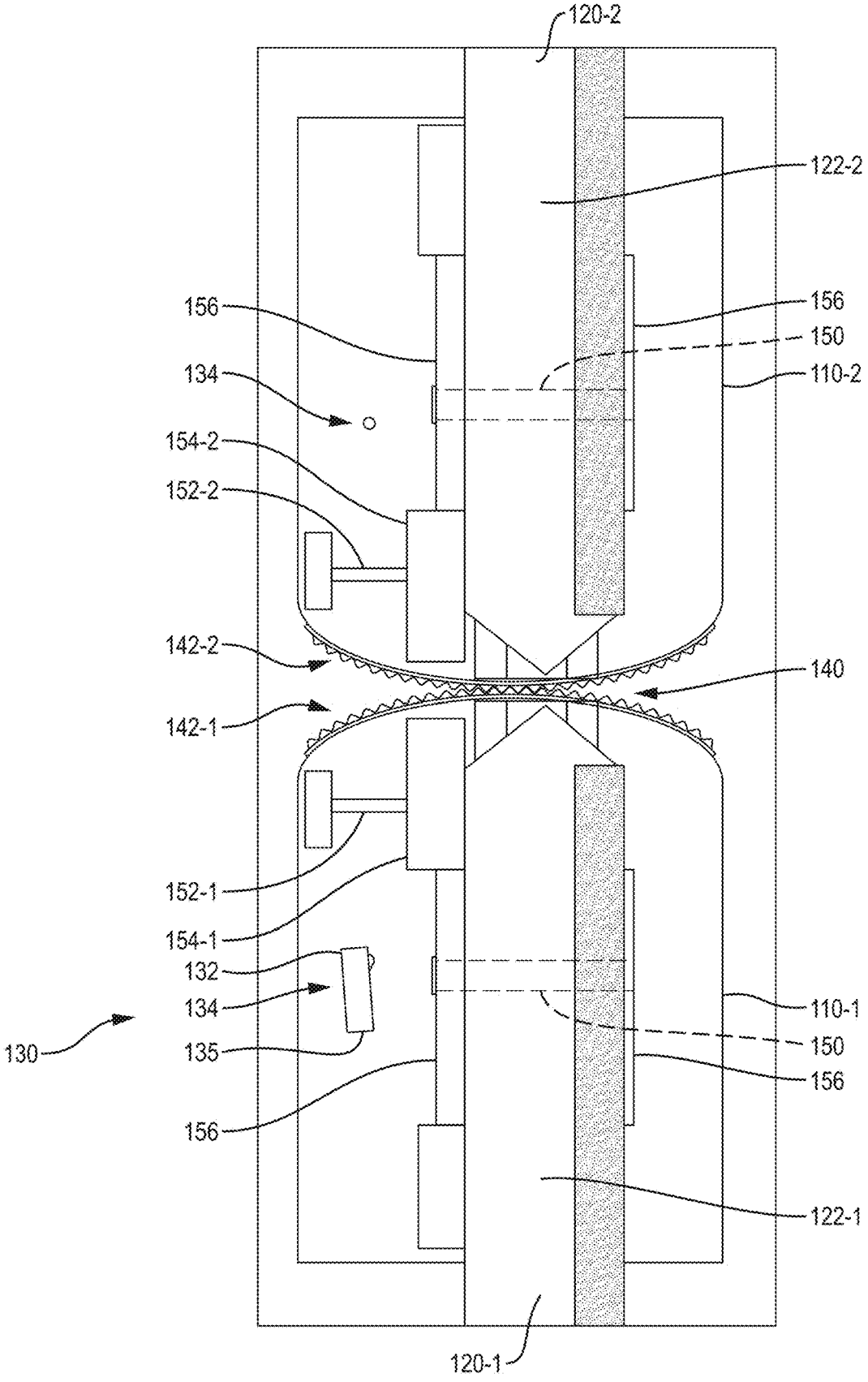
FIG. 5 shows a plan view of an alternate configuration of the foot positioning apparatus of FIGS. 1-4.

FIG. 5 shows a plan view of an alternate configuration of the foot positioning apparatus of FIGS. 1-4. Referring to FIGS. 3-5, a locking mechanism and a rotational linkage between the platforms 110 is shown. A locking mechanism 130 for the rotating platforms 110 includes a locking member 132 passing through an aperture 134 in the rotating platform and engaged in a receptacle 136 in the base 112 aligned with the aperture. The base 112 further includes a series of engaging receptacles 136 for defining a plurality of fixation positions, typically 5. Each of the engaging receptacles 136 aligns with the aperture 134 in the rotating platform for receiving a rotational locking member 132 when aligned with an engaging receptacle at an increment of rotation. In other words, as the platform rotates, each of the 5 engaging receptacles passes under and aligns with the aperture for receiving a locking member and fixing the rotating platform via an interference fit at the respective position. Any suitable number and granularity of receptacles 136 may also be employed. The locking member 132 may be a handled 135 dowel or other rigid member capable of extending through the aperture in the rotating platform and into the aligned engaging receptacle.

The rotating platforms 110 each include a cooperative rotational linkage 140 between the rotating platforms 110. The rotational linkage disposes each of the rotating platforms 110 in a rotational increment or pivot corresponding to the other of the opposed rotating platforms 110-N. In the example configuration, each platform 110 has a respective row 142-1, 142-2 of resilient, engaged teeth intermeshed in a rotational linkage for imparting an equal pivot to each of the opposed rotating platforms. In contrast to the approach depicted in FIG. 3, having independently rotating platforms 110, the rotational linkage 140 embraces the reality that most users prefer an equal angular rotation for each foot. The rotational linkage 140 also provides that only one of the platforms 110 need the locking mechanism 130, as the opposed rotational platform will be fixed by the rotational linkage.

Figure 6:
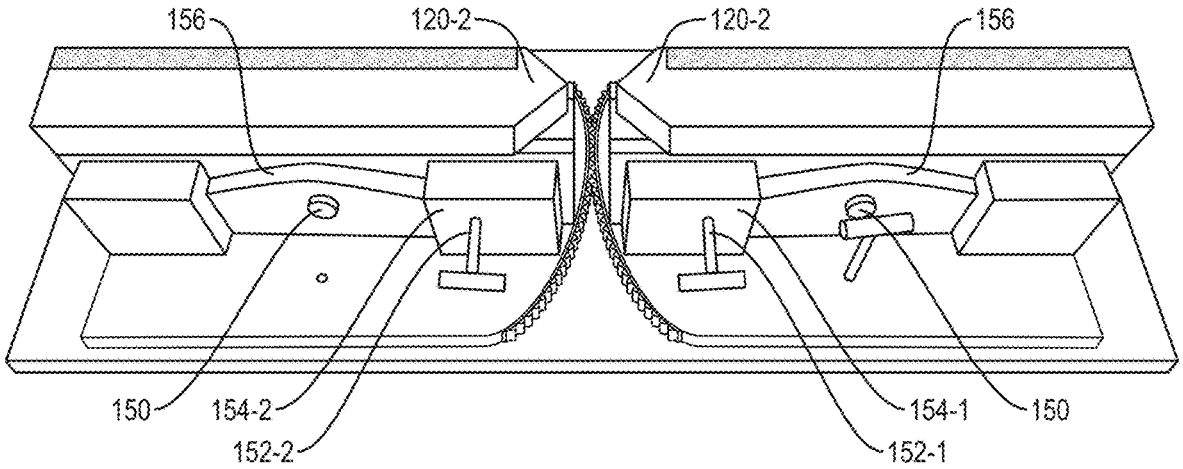
FIG. 6 shows a perspective view of the foot positioning apparatus of FIG. 5.

FIG. 6 shows a perspective view of the foot positioning apparatus of Fig. Continuing to refer to FIGS. 3-6, in a somewhat similar arrangement, a pivot shaft 150-1, 150-2 (150 generally) provides a fulcrum for engaging each of the pivoting foot braces 120 for rotation thereof, and a pivot locking pin 152 is adapted for engagement in an interference fit with each respective pivoting foot brace 120 for locking the angle of the pivot. Flanking fulcrum blocks 156 support the pivot shaft for pivot/rotational movement. The locking pin 152 may engage corresponding holes in the pivoting foot brace 120, or may simply reside in a transverse orientation beneath the foot brace. An aperture block 154-1 . . . 154-2 has a bore for fixing the locking pin 152 in an interference fit with the foot brace 120. Any suitable number of pivot positions and engaging receptacles may be provided depending on a desired range and increment of movement.

Figure 7A:
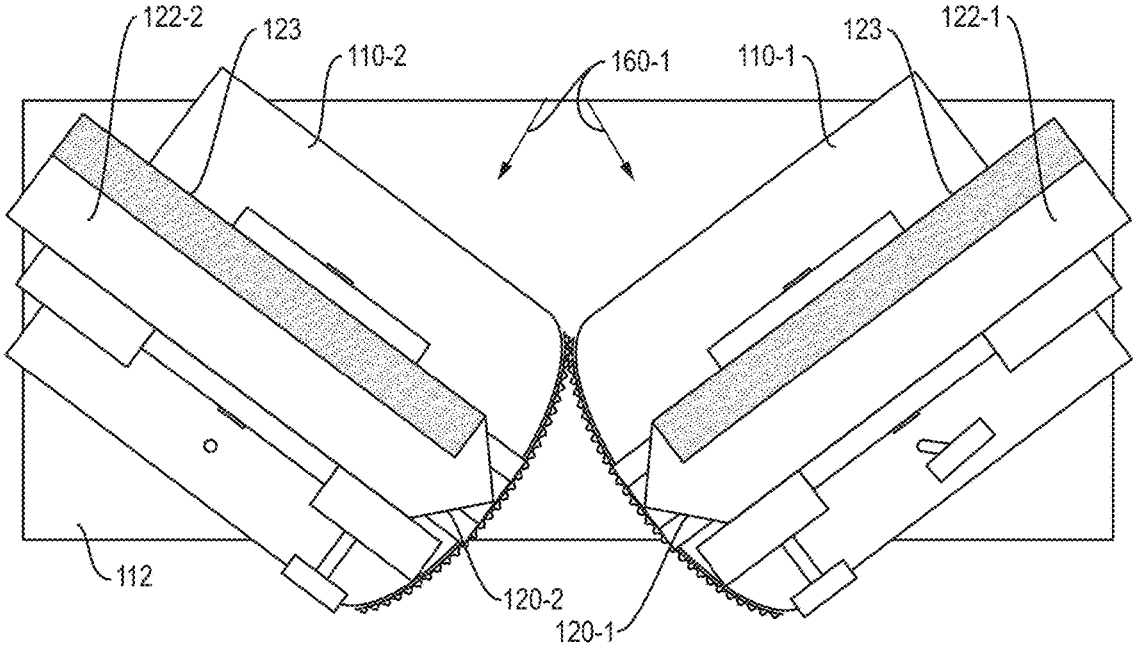
FIGS. 7A-7C show rotation of the foot platforms in the apparatus of FIGS. 5 and 6.
Figure 7B:
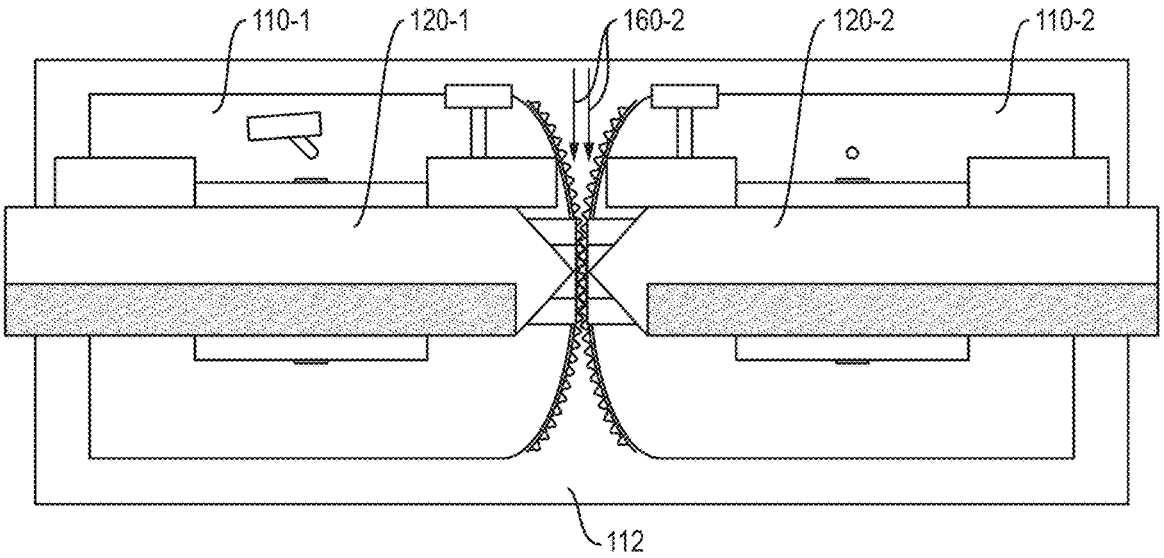
Figure 7C:
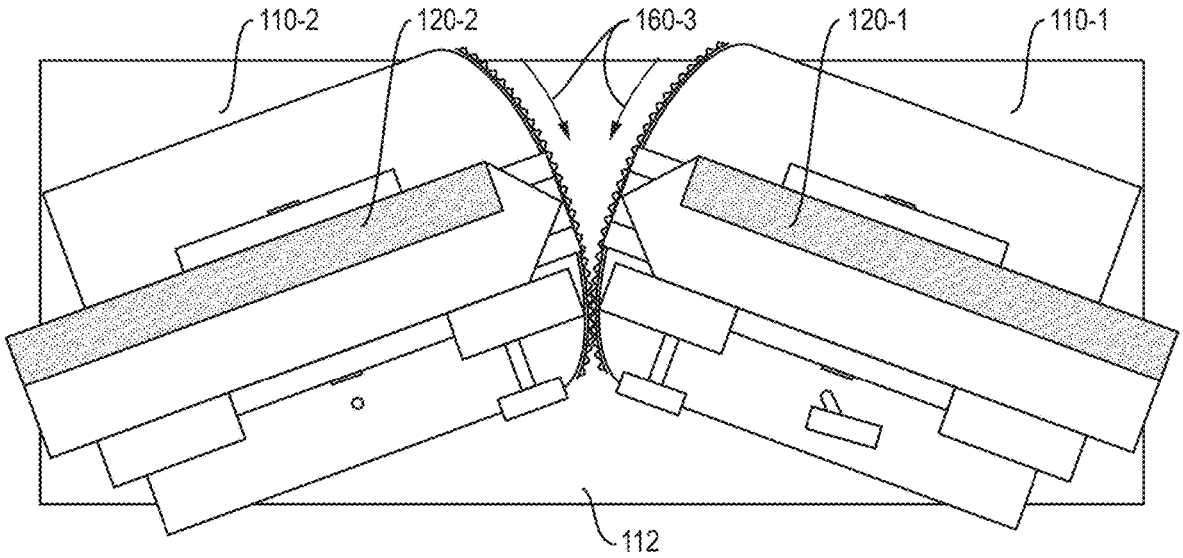

FIGS. 7A-7C show rotation of the foot platforms in the apparatus of FIGS. 5 and 6. Referring more specifically to FIGS. 5 and 7A-7C, FIG. 7A shows a toe-outward pivot, shown by arrows 160-1, where the footrest 122 is shown in a position for toes angled out, converging towards the heel (the examples show platform 110-1 disposed for a left foot and platform 110-2 for a right foot, with friction material 123 on a shoe-engaging side of the footrest 122). FIG. 7B illustrates the relation between the rotating platform 110-1 . . . 110-2 axes of rotation 210-1 . . . 210-2, respectively, oriented as a Z axis, or out of page, perpendicular to the pivot axes 250-1 . . . 250-2 of the pivot shafts 150-1 . . . 150-2, respectively. FIG. 7B also shows the footrests angled ahead, for disposing the feet in a substantially parallel arrangement by arrows 160-2, and FIG. 7C shows a toe-in configuration converging towards the toe, shown by arrows 160-3.

Figure 8A:
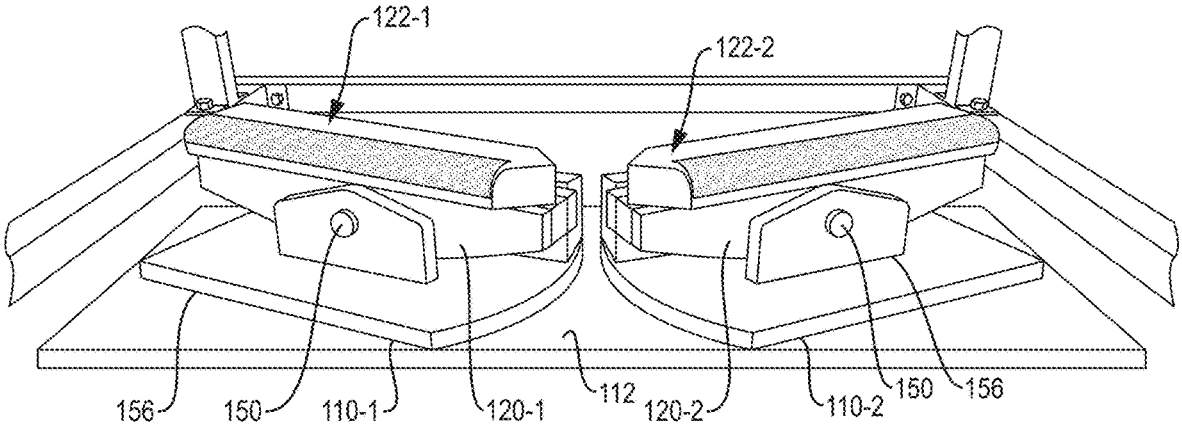
FIGS. 8A-8C show various pivot positions of the foot brace.
Figure 8B:
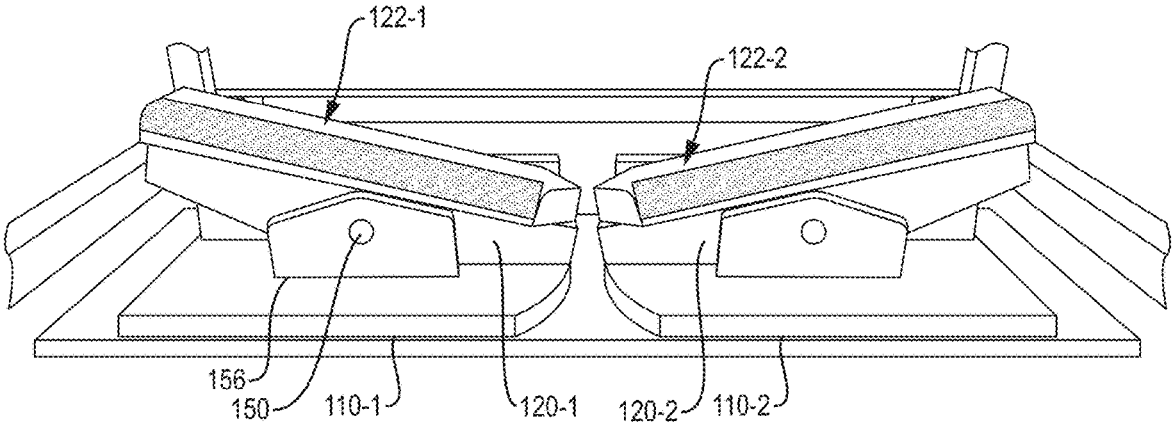
Figure 8C:
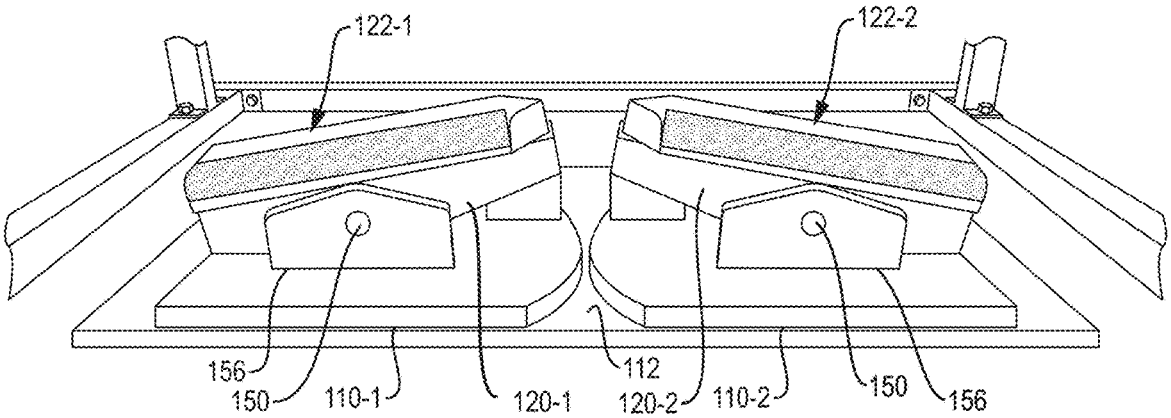

FIGS. 8A-8C show various pivot positions of the foot brace 120. In contrast to the variations of FIGS. 7A-7C, the foot brace adjusts (pivots) in a vertical plane relative to the base 112, while the rotational positions of the platforms 110 depict rotation in a plane parallel to the base 112. In an example arrangement, the locking pin 152 is positionable for three pivot positions, including a level horizontal position (FIG. 8A), a sloped inward (FIG. 8B) and a sloped outward position (FIG. 8C).

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. A foot positioning apparatus for varying foot orientation during an exercise regimen, comprising:

opposed rotating platforms disposed in an adjacency on a plane for rotation;

a pivoting foot brace on each of the rotating platforms, each of the foot braces disposed t pivot about a pivot axis perpendicular to an axis for rotation of the rotating platforms;

a locking mechanism extending through each of the respective rotating platforms for securing a position of the rotating platforms;

a locking mechanism for securing an angle of the pivot for each of the foot braces via an interference fit;

a footrest defined by an elevated surface on each of the foot braces, the foot braces having a predetermined elevation above the rotating platforms, the predetermined elevation based on a heel travel imposing calf resistance; and the locking mechanism for each of the respective rotating platforms includes a rotational locking member configured to pass through a locking aperture in the respective rotating platform and engage in an engaging receptacle aligned with the locking aperture.

2. The device of claim 1 further comprising a base, the base having a pair of protrusions defining the axis of rotation for each of the rotating platforms, each protrusion extending through an axial receptacle on a respective underside of each of the rotating platforms, in alignment with the axis of rotation.

3. The device of claim 2 wherein the base further comprises a series of engaging receptacles for defining a plurality of fixation positions for each of the rotating platforms, each of the engaging receptacles configured to align with the locking aperture in a respective one of the rotating platforms and receive the respective rotational locking member to lock the rotating platform at an increment of rotation.

4. The device of claim 1 further comprising a pivot shaft engaging each of the pivoting foot braces for angular movement thereof, and wherein the locking mechanism for each foot brace comprises a locking pin adapted for engagement in an interference fit with the respective foot brace for locking the angle of the pivot.

5. The device of claim 4 wherein the locking pin is positionable for a plurality of pivot angle positions for each of the foot braces, the positions including a level horizontal position, a sloped left and a sloped right position.

6. The device of claim 1 further comprising a rotational linkage between the rotating platforms, the rotational linkage disposing each of the rotating platforms in a pivot corresponding to the other of the rotating platforms.

7. The device of claim 1 further comprising a rotational linkage for imparting an equal pivot to each of the opposed rotating platforms.

8. A method for forming an exercise apparatus for varying foot orientation during an exercise regimen, comprising:

disposing opposed rotating platforms disposed in an adjacency on a plane for rotation;

attaching a pivoting foot brace on each of the rotating platforms, each of the foot braces disposed to pivot in a pivot axis perpendicular to an axis for rotation of the rotating platforms;

engaging a locking mechanism extending through each of the respective rotating platforms for securing a position of the rotating platforms;

engaging a locking mechanism for securing an angle of the pivot for each of the foot braces via an interference fit;

forming a footrest on each of the foot braces defined by an elevated surface having a predetermined elevation above the rotating platforms, the predetermined elevation based on a heel travel imposing calf resistance; and wherein engaging the locking mechanism for each of the respective rotating platforms includes passing a rotational locking member through a locking aperture in the respective rotating platform for engaging in an engaging receptacle aligned with the locking aperture.

9. The method of claim 8 further comprising attaching the rotational platforms to a base, the base having a pair of protrusions defining the axis of rotation for each of the rotating platforms, each protrusion extending through an axial receptacle on a respective underside of each of the rotating platforms.

10. The method of claim 9 further comprising forming a series of engaging receptacles on the base for defining a plurality of fixation positions for each of the rotating platforms, each of the engaging receptacles configured to align with the locking aperture in a respective one of the rotating platforms and receive the respective rotational locking member to lock the rotating platform at an increment of rotation.

11. The method of claim 8 further comprising disposing a pivot shaft to engage each of the pivoting foot braces for angular movement thereof, and wherein engaging the locking mechanism for each of the foot braces includes inserting a locking pin adapted for engagement in an interference fit with the respective foot brace for locking the angle of the pivot, the angle of the pivot independent for each of the foot braces on the respective rotating platforms.

12. A method for forming an exercise apparatus for varying foot orientation during an exercise regimen, comprising:

disposing opposed rotating platforms disposed in an adjacency on a plane for rotation;

attaching a pivoting foot brace on each of the rotating platforms, each of the foot braces disposed to pivot in a pivot axis perpendicular to an axis for rotation of the rotating platforms; and forming a footrest on each of the foot braces defined by an elevated surface having a predetermined elevation above the rotating platforms, the predetermined elevation based on a heel travel imposing calf resistance;

affixing an intermeshed set of protrusions on the rotating platforms for defining rotational linkage between the rotating platforms, the rotational linkage disposing each of the rotating platforms in a pivot corresponding to the other of the rotating platforms.

* * * * *